US006334551B1

(12) United States Patent
Taghavi-Khanghah

(10) Patent No.: US 6,334,551 B1
(45) Date of Patent: Jan. 1, 2002

(54) CONTAINER VALVE

(75) Inventor: Said Taghavi-Khanghah, Newcastle Upon Tyne (GB)

(73) Assignee: Veresk Biosystems Limited, Newcastle Upon Tyne (GB)

( * ) Notice: Subject to any disclaimer, the term of this patent is extended or adjusted under 35 U.S.C. 154(b) by 0 days.

(21) Appl. No.: 09/762,214

(22) PCT Filed: Jul. 30, 1999

(86) PCT No.: PCT/GB99/02512

§ 371 Date: Feb. 5, 2001

§ 102(e) Date: Feb. 5, 2001

(87) PCT Pub. No.: WO00/07899

PCT Pub. Date: Feb. 17, 2000

(30) Foreign Application Priority Data

Aug. 3, 1998 (WO) ..... PCT/GB98/02328

(51) Int. Cl.[7] ..... B65D 37/00
(52) U.S. Cl. ..... 222/212; 222/496
(58) Field of Search ..... 222/131, 212, 222/213, 481, 482, 494, 495, 496

(56) References Cited

U.S. PATENT DOCUMENTS 4,420,100 A * 12/1983 Mueller ..... 222/212
5,197,638 A * 3/1993 Wood ..... 222/212
5,431,310 A * 7/1995 Kanner et al. ..... 222/212

* cited by examiner

*Primary Examiner*—Philippe Derakshani
*Assistant Examiner*—Thach H Bui
(74) *Attorney, Agent, or Firm*—Larson & Taylor PLC

(57) ABSTRACT

A container for dispensing liquids comprises a body member and a closure including a cap in the form of a plastic molding having an outlet and a control valve within the cap for controlling the dispensing of liquid through the outlet, the control valve being in the form of a one piece plastic molding having a diaphragm portion and a nose portion, the nose portion of the valve normally sealing the outlet but being displaceable therefrom on distortion of the diaphragm portion resulting from pressurization of the interior of the body member, the cap further including a one-way valve which, on pressurization of the interior of the body member, is closed to seal the interior of the cap from the atmosphere, and, on release of pressure from the interior of the body member, opens to interconnect the interior of the cap with the atmosphere to facilitate return of the body member to its normal rest condition.

16 Claims, 4 Drawing Sheets

CONTAINER VALVE

TECHNICAL FIELD

This invention relates to containers, and more particularly to containers for dispensing pastes, gels, creams and other products hereinafter referred to as liquids.

BACKGROUND

It is often desirable to be able to dispense controlled quantities of liquid from an elongate container, tube or the like through an outlet in the cap of the container at an angle to the direction of flow of liquid from the container to the cap, rather than through an outlet in the top of the container, and in a wiping action directly onto the skin, for example the arm or leg, for subsequent rubbing into the skin for treatment purposes.

Such a wiping action is most conveniently achieved by using a container having a relatively long neck and a narrower cap to provide an ergonomic profile to the container.

However, the number of such containers available with such angled side outlets is limited, while those that are currently available suffer from a number of disadvantages, not the least of which are that the dispensing mechanisms thereof are of relatively complex construction and are expensive to manufacture.

For example, U.S. Pat. No. 5,197,638 discloses a container having a nozzle provided with an outlet which dispenses the contents of the associated container in a direction perpendicular to the direction of feed of the content of the container to the nozzle and under the control of a flexible diaphragm. However, the nozzle incorporates a tortuous series of channels/passageways for the flow of fluid to the outlet, while the diaphragm is integral with, or connected to, a piston of complex configuration urged by a spring into a normal rest position sealing the outlet. Clearly such an arrangement is expensive to manufacture and requires careful manual assembly, while it has also been found to suffer from hygiene problems.

Reference is also made to U.S. Pat. No. 4,798,311, CH 225084 and U.S. Pat. No. 2,170,588 all of which disclose containers with outlets in the sides thereof, but all of which are also of relatively complex construction, difficult to manufacture and difficult to assemble, and to U.S. Pat. No. 3,008,611 disclosing a metal container which, on inversion and squeezing, dispenses liquid through an outlet in the cap under the control of a valve element comprising a one-piece plastic extrusion, the container further including a one-way valve in the form of a vented rubber gasket to facilitate restoration of the sides of the container subsequent to dispensing.

SUMMARY OF THE INVENTION

It would be desirable to be able to provide a container capable of controlled dispensing of liquid, particularly but not exclusively from a side outlet therein, and of a simpler, more hygienic construction and more economically manufactured than heretofore, preferably suitable for automated assembly to enable efficient high volume production.

According to the present invention there is provided a container comprising a body member for containing liquid and a neck at one end thereof through which liquid flows on pressurization of the interior of the body member, and a closure for the body member including a cap located on the neck of the body member and having an outlet therein for dispensing therethrough liquid flowing through the neck of the body member, a control valve located within the cap for controlling the dispensing of liquid flowing from the body member to the outlet from the cap, the control valve being a one piece plastic moulding including a diaphragm portion and a nose portion extending from one side of said diaphragm portion, and having a rest position in which the nose portion engages in, to seal, the outlet from the cap, and a one-way valve in the flow path of liquid from the body member to the outlet and communicating with the atmosphere, said one-way valve having a closed position sealing the interior of the container from the atmosphere and an open position interconnecting the interior of the container with the atmosphere, the arrangement being such that, on pressurization of the interior of the body member, liquid from the body member flows through the neck of the body member into the cap to close the one-way valve and to engage with the one side of the diaphragm portion of the control valve to distort said diaphragm portion whereby the nose portion of the control valve is displaced from the outlet and liquid is dispensed therethrough, and, on subsequent release of pressure from the interior of the body member, the control valve returns, under the influence of its inherent resiliency and atmospheric pressure, to its rest position with the nose portion thereof seating in, to seal, the outlet, and the one-way valve opens to facilitate re-pressurization of the interior of the body member, characterized in that the cap includes an annular seating for the control valve projecting inwardly of the cap and being of hollow, open-ended generally cylindrical shape the bore through which interconnects the interior of the cap with the atmosphere, the control valve being mounted on the seating with the diaphragm portion thereof sealing the inner end of the seating and whereby the other side of the diaphragm portion remote from the nose portion is subjected to atmospheric pressure.

It will be appreciated that, with such an arrangement, the closure for the body member can be of extremely simple construction and can comprise a minimal number of individual components which can be readily manufactured by plastic moulding techniques, and, where appropriate, automatically assembled, the provision of the one-way valve ensuring quick and efficient return of the body member to its normal rest condition.

The control valve may be overmoulded on the inner end of the seating.

The annular seating may be integrally moulded with the cap.

Alternatively the annular seating may be separate from, and be a push-fit into, the cap.

The separate seating may have integrally formed therewith a secondary seating adapted to receive therein the one-way valve such as to locate said one-way valve in the flow path of liquid from the interior of the body member to the outlet from the cap.

The separate seating may be interconnected with the cap by means of a reduced-thickness hinge.

The one-way valve may be mounted in the cap or in the neck of the body member.

The outlet may be formed in a plate portion movable relative to the remainder of the cap between a normal position completing the cap and a displaced position providing access to the interior of the cap and to the control valve.

The plate portion may be integrally moulded with the remainder of the cap and movable relative thereto by means of a hinge, or may be separate from the remainder of the cap and a snap fit into an associated operative position in the remainder of the cap.

It will be appreciated that the provision of the annular seating open to the atmosphere and the movable plate portion combine to enable ready, automated assembly of the container, in that the control valve can be inserted into the cap through the open plate portion, positioned on the seating, and the plate portion subsequently closed to completed the closure.

Furthermore, the provision of the apertured seating and the movable plate portion as disclosed permits ready overmoulding of the control valve on the seating, in that the opposed metal inserts or dies for forming the valve can be inserted one through the seating and the other through the open plate portion whereby the control valve can be formed on the seating.

The closure may include a plug member adapted to be a friction fit within the cap to engage the other side of the diaphragm portion of the control valve remote from the nose portion and to retain the nose portion in its rest position engaging in, to seal, the outlet, such an arrangement serving to prevent inadvertent dispensing from the container.

Conveniently, the plug member is integrally moulded with the cap and is pivotal relative thereto about a reduced thickness hinge between an operative position engaging the diaphragm portion of the valve and a released position displaced from the control valve.

The closure may be integrally moulded with the body member to form a continuation of the neck of said body member.

DESCRIPTION OF THE PREFERRED EMBODIMENTS

Figure 1:
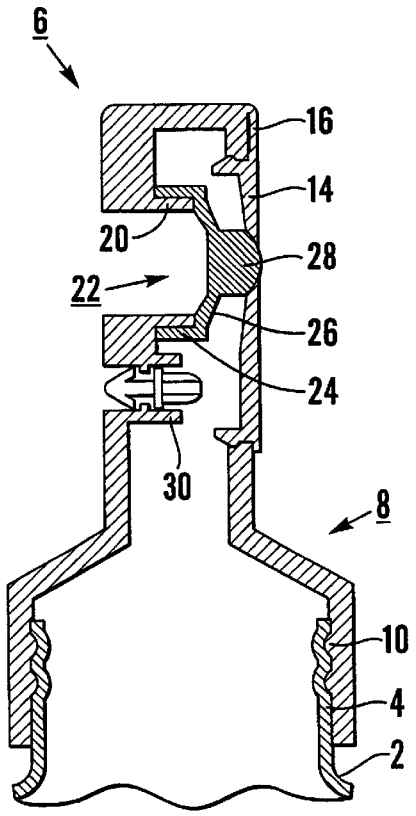
FIGS. 1 and 2 are vertical sections through part of a first container according to the invention the closure for which includes a plate portion, with the plate portion in its normal position and its displaced position respectively.
Figure 2:
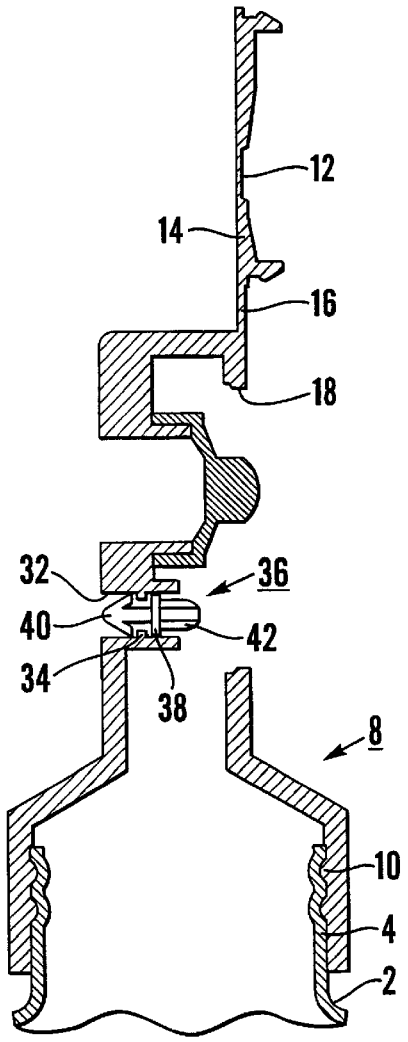

Referring to FIGS. 1 and 2 there is shown part of a container comprising a body portion or reservoir 2 of a flexible plastics material, and including a reduced-diameter, externally threaded neck 4.

A closure for the body member 2 is indicated generally at 6 and includes a hollow cap 8 moulded from a semi-rigid plastic material such as polythene or polyethylene. The cap 8 has an internally threaded skirt 10 at its lower regions for co-operation with the thread on the neck 4 to locate the closure 6 on the body member, although this location could be effected by means of a snap fit between the components or by the closure 6 being integrally moulded with the body member 2.

The upper regions of the cap 8 are of reduced diameter and include an outlet 12 in a sidewall thereof. More particularly, the outlet 12 is formed in a plate portion 14 forming part of the sidewall of the cap 8 but being mounted to the remainder of the cap 8 by means of a reduced thickness hinge 16 whereby the plate portion 14 can be pivoted between a normal operative position shown in FIG. 1 in which it is a sealing snap fit in a corresponding aperture 18 formed in the cap 8, and an open position shown in FIG. 2 displaced from said aperture 18 and providing access to the interior of the cap 8. Alternatively the plate portion 14 may be separate from the remainder of the cap 8 and not connected thereto by a hinge or other means.

Integrally moulded in the cap 8 opposite the outlet 12 is a hollow, open-ended cylindrical primary seating 20 which extends radially into the upper regions of the cap 8, the central axis of the seating 20 being perpendicular to the central axis of the neck 4 of the body member 2, said central axis of the seating 20 passing through the outlet 12, the hollow bore through the seating 20 interconnecting the interior of the cap 8 with the atmosphere.

The closure 6 further includes a control valve indicated generally at 22 and comprising an annular skirt portion 24 one end of which is closed by a circular diaphragm portion 26 on the surface of which remote from the skirt portion 24 is formed a central nose portion 28. The valve 22 is integrally moulded from a soft thermoplastic material, or an elastomer or a silicone rubber with the skirt portion 24 being sealingly located on the seating 20 whereby the diaphragm portion 26 defines a barrier between the interior of the cap 8 and the atmosphere. The skirt portion 24 may be a friction fit on the seating 20 or may be moulded thereto to be integral with the cap 8.

In the rest position of the valve 22, the nose portion 28 thereof is urged into, to seal, the outlet 18, with atmospheric pressure being applied to the surface of the diaphragm portion 26 remote from the nose portion 28.

Also integrally moulded in the cap 8 below the primary seating 20 is a secondary seating 30 of generally hollow cylindrical shape extending into the cap 8 and forming a continuation of an aperture 32 provided in the wall of the cap 8. An annular step or ridge 34 is formed internally of the aperture 32 for reasons which will become apparent.

A one-way valve of moulded plastics material is indicated generally at 36 and is located within the seating 30 and aperture 32, the valve 36 comprising a plate portion 38 the diameter of which is less than the internal diameter of the seating 30 but greater than the internal diameter of the step 34, a head portion 40 in the form of an arrow being provided to one side of the plate portion 38, and a tail portion 42, which may be of cruciform transverse section, extending from the other side of the plate portion 38.

The valve 36 is positioned in the cap 8 by pressing the head portion 40 of the valve through the step 34 from the inside of the cap, the arms thereof then co-operating with the external face of the step 34 to prevent removal of the valve 36 once inserted, and the valve 36 being movable axially of the seating 30 between a first position in which the plate portion 38 seats on the internal face of the step 34 to seal the aperture 32, and a second position in which the arms of the head portion 40 seat on the external face of the step 34 to open the aperture 32 and interconnect the interior of the cap 8 with the atmosphere.

In order to dispense the content of the container, the body portion 2 thereof is squeezed to pressurise the interior of the container. This increase in pressure forces the content of the container through the neck 4 into the closure 6 and into forcible engagement with the surface of the diaphragm portion 26 carrying the nose portion 28.

The diaphragm portion 26 is thus displaced to the left as viewed in FIG. 1 whereby the nose portion 28 is displaced from the outlet 12, and the content of the container is dispensed through said outlet 12.

Conveniently this dispensing is accompanied by a downward movement of the container with the outlet 12 against the skin of a user whereby the liquid, for example moisturising cream or sun-tanning cream, is deposited on the skin of the user for subsequent rubbing therein.

The pressure of liquid within the closure 6 also acts on the valve 36, and in particular on the plate portion 38, which is urged into its first position sealing the aperture 32 and maintaining pressure within the closure 6.

On release of the squeezing pressure from the body member 2, and by virtue of its inherent resiliency and the application of atmospheric pressure on the surface of the diaphragm portion 26 remote from the nose portion 28, the control valve returns to the normal rest position seating in and sealing the outlet 12, thereby terminating dispensing of the content from the container.

The reduction in pressure within the body member 2 results in the valve 36 being moved, under the influence of atmospheric pressure on the plate portion 38, to its second or open position whereby the interior of the closure 6 and the body member 2 are interconnected with the atmosphere by way of the aperture 32. Thus the speed of return of the body member 2 to its normal rest condition on release of the squeezing pressure therefrom is improved as a result of air flowing into the container through the aperture 32.

It will be appreciated that the described container is of relatively simple and therefore inexpensive construction, and is particularly suited to automated assembly. The provision of the hollow seating 20 and the movable plate portion 14 enables the control valve 22 to be overmoulded to the seating 20, the opposed relevant metal shapers or inserts being capable of insertion through the seating 20 and the aperture 18. The control valve 22 may exclude the skirt portion 24, with the peripheral regions of the diaphragm portion 28 being overmoulded on the seating 20.

Additionally, the provision of the hinged plate portion 14 enables ready access to the interior of the closure 6 whereby the control valve 22 and one-way valve 36 can be located in their operative positions on the seatings 20,30 through the aperture 18, again facilitating automated assembly.

The provision of the outlet 12 in the side of the closure 6, as distinct from the end thereof, makes the container of the invention particularly suited to the application of the content thereof to the skin with the aforementioned wiping action, such application ensuring all the dispensed liquid is deposited on the skin with the wiping action serving to remove all liquid from the exterior of the outlet and ensuring cleanliness and improved hygiene compared with equivalent containers. The outlet 12 may, however, be in the end of the closure 6.

In an alternative embodiment of the invention particularly suited to narrow-necked containers, the control valve 22 does not include a skirt portion 24 and the closure does not include the seating 20, the peripheral edge regions of the diaphragm portion 26 being secured directly to the cap 8. More particularly the edge regions of the diaphragm portion 26 of the valve 22 may be overmoulded to the bounding edge of the circular aperture formed in the sidewall of the cap 8 opposite the outlet 12, with the other side of the diaphragm portion 26 exposed to the atmosphere.

Figure 3:
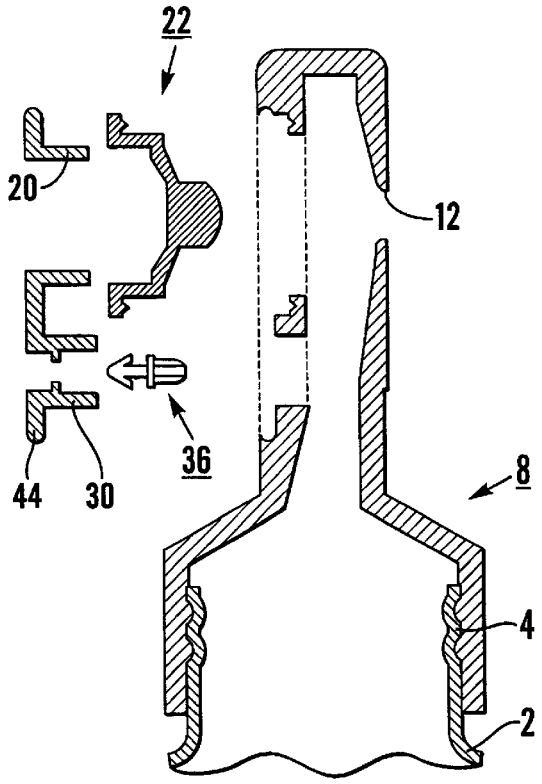
FIGS. 3 and 4 are vertical sections through part of a second container according to the invention, prior to assembly and subsequent to assembly respectively of the associated closure.
Figure 4:
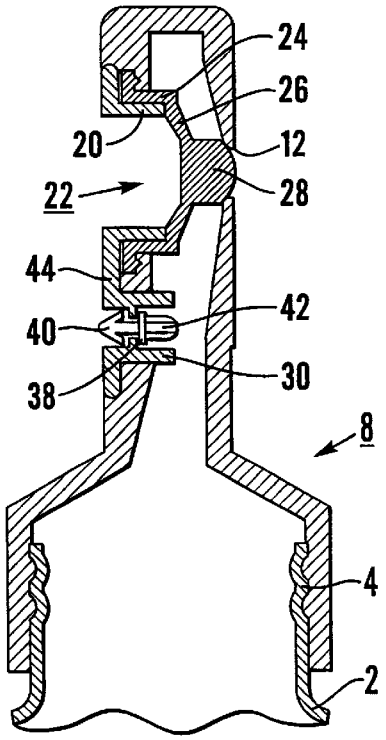

FIGS. 3 and 4 show a further embodiment of the invention in which the seatings 20,30 are formed separately from the cap 8 and comprise a unitary insert 44 which, together with the control valve 22 and one-way valve 36 mounted thereon, is a snap-fit into a corresponding aperture in the sidewall of the cap 8 opposite the outlet 12.

It will be appreciated that the arrangement of FIGS. 3 and 4 is also particularly suited to automated assembly, while the control valve 22 can be separate from or overmoulded to the seating 20. The pivotal plate portion has been dispensed with, the outlet 12 being formed directly in the cap 8.

Figure 5:
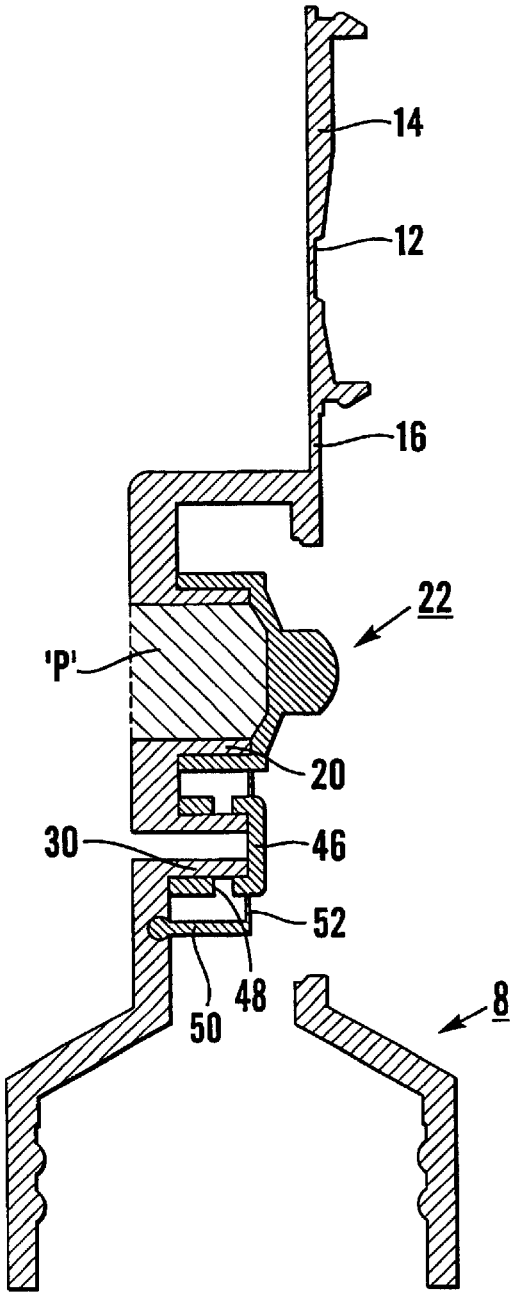
FIG. 5 is a vertical section through a closure for a third container according to the invention which includes a plate portion, the plate portion being in its displaced position.
Figure 5A:
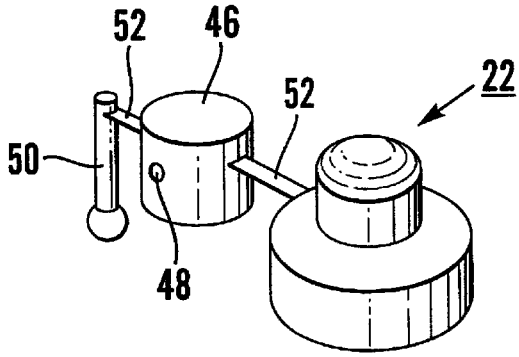
FIG. 5*a* shows the control valve and one-way valve of the closure of FIG. 5 in perspective.

FIGS. 5 and 5*a* show part of a container similar to that of FIGS. 1 and 2 other than in the configuration of the one-way valve.

More particularly, the one-way valve comprises a flexible plastics cap 46 adapted to seat over the hollow cylindrical seating 30 and having a normal rest position as shown in FIG. 5 in which the end wall of the cap 46 seals the bore through the seating 30.

A pair of diametrically opposed holes 48 are formed in the cap 46, while the control valve 22 and the one-way valve 46 are integrally moulded as shown in FIG. 5*a,* the moulding further including a retaining pin member 50 the increased-diameter head of which is a friction fit in an associated aperture within the cap 8 to locate the assembly within the cap 8, and flexible connecting strips 52 between the cap 46 and the valve 22, and between the cap 46 and the member 50.

The arrangement is such that, when the pressure within the container 2 falls below atmospheric pressure, as will occur on release of the squeezing pressure from the body member 2, the cap 46 is urged inwardly under atmospheric pressure to disengage from the end of the seating 30. This movement of the cap 46, which is controlled by the flexible strips 52, interconnects the bore in the seating 30 with the holes 48 in the cap whereby air can flow into the interior of the container to assist return of the body member 2 to its normal rest condition.

Inadvertent dispensing from the container, for example during travelling, may be prevented in any one of a number of different ways. For example, the closure 6 may be provided with a plug, such as that referenced P in FIG. 5, which is a tight friction fit in the volume defined by the seating 20 and the surface of the diaphragm portion 26 remote from the nose portion 28, said plug engaging said surface of the diaphragm portion 26 to prevent deflection of the diaphragm portion 26 until the plug 32 is removed from the volume. Conveniently the plug 32 is integrally moulded with the cap 8 and is connected thereto by a reduced thickness hinge to enable movement of the plug 32 into and out of its operative position in engagement with the valve 22.

Figure 6:
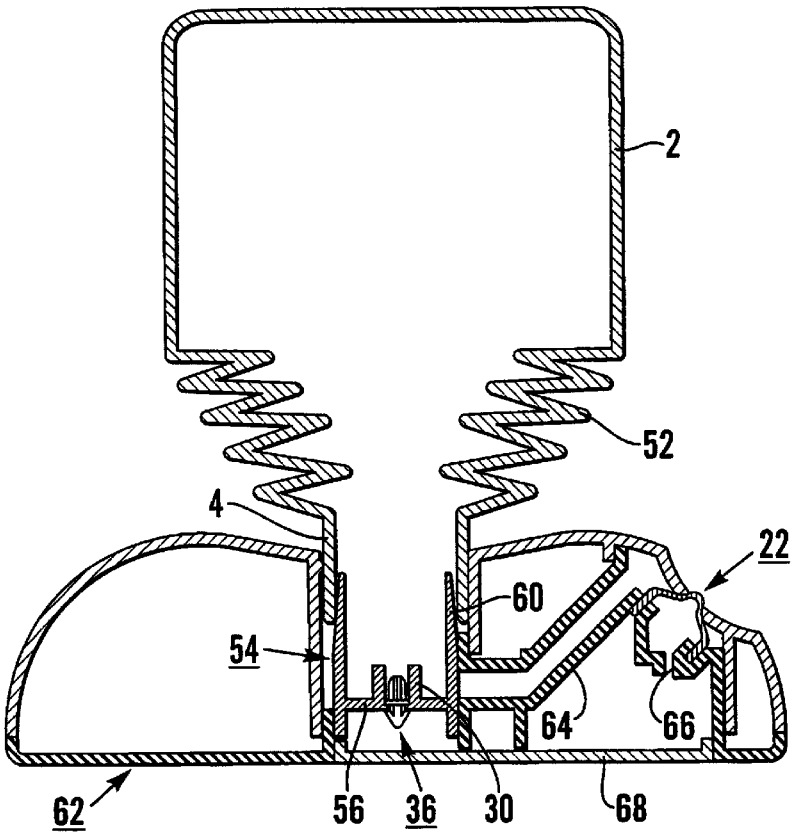
FIGS. 6 and 7 are vertical sections through a fourth container according to the invention with the closure in a closed and an open position respectively.
Figure 7:
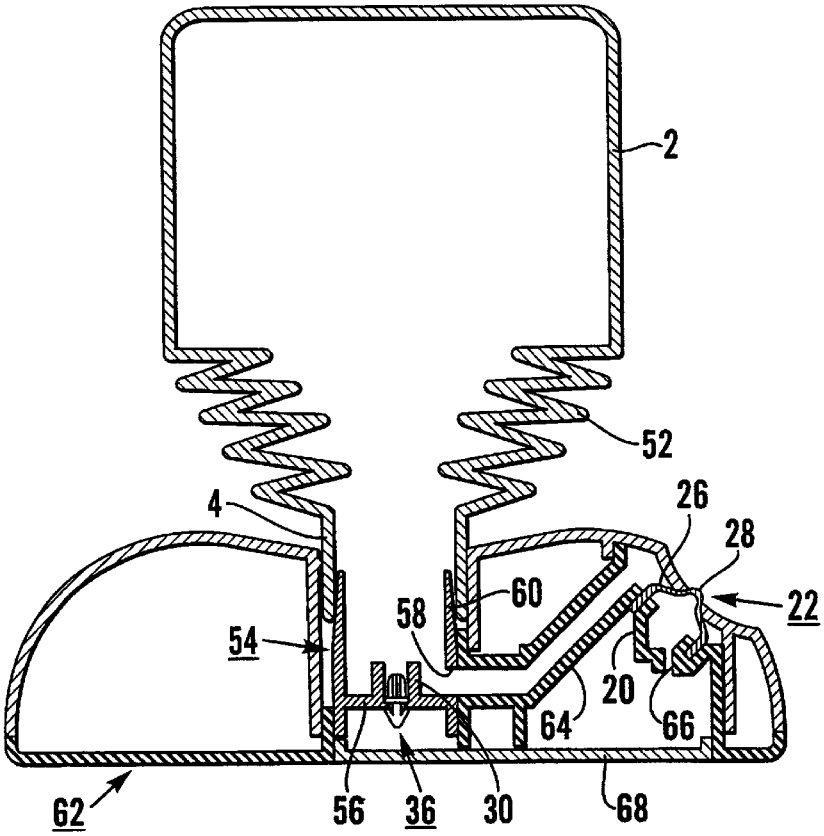

Referring to FIGS. 6 and 7 there is shown a still further embodiment of the invention in which components equivalent to those of the earlier embodiments are similarly referenced.

The container is a so-called volume dispenser and includes a bellows-like section 52 compression of which controls the volume of liquid dispensed from the body member 2 of the container through the outlet 12.

More particularly, the neck 4 of the body member 2 feeds into a chamber 54, which may be integrally formed with the neck 41 an end wall 56 of said chamber 54 incorporating the seating 30 and one-way valve 36. An aperture 58 is formed in the sidewall 60 of the chamber 54.

The container includes a cap 62 of plastics material mounted on the body member 2 to be rotatable relative to the body member 2 between a closed position shown in FIG. 6 and an open position shown in FIG. 7. The cap 62 includes a passageway 64 therein which feeds from a position adjacent the chamber 54 to a volume surrounding the control valve 22 and including the surface of the diaphragm portion 26 of the valve 22 carrying the nose portion 28. The other surface of the diaphragm portion 26 is open to atmosphere by way of an aperture 66 in the seating 20. The cap 62 further includes a plate 68 which is a non-sealing fit thereon for cosmetic purposes.

In order to dispense liquid from the container, the cap 62 is rotated from the position shown in FIG. 6 to that shown in FIG. 7 to align the passageway 64 with the aperture 58 in the sidewall 60 of the chamber 54. The bellows-like section 52 is then compressed and liquid is dispensed from the container through the outlet 12 in the manner detailed above in respect of the preceding embodiments.

On release of pressure from the body member, the bellows-like section 52 returns to its normal extended condition, facilitated by the intake of air through the one-way valve 36, while the control valve 22 returns to its normal rest condition facilitated by atmospheric pressure through the aperture 66.

Clearly the precise construction of the containers could differ from those described and illustrated without departing from the scope of the invention. For example, the container may include a number of outlets 12 and a corresponding number of control valves 22, each outlet having a number of bristles associated therewith externally of the cap whereby the content of the container can be applied in the manner of a brush, while the configuration of the control valve, in particular the nose portion 28 thereof, may be altered. In all embodiments of the invention, it is preferred that, in its normal rest position, the nose portion of the valve extends right through the outlet whereby no liquid can remain in said outlet after use of the container. The end of the nose portion of the valve may also extend right through the outlet even in the open position of the valve, whereby liquid dispensed through the outlet, for example nail varnish, may be applied by the end of the nose portion.

The one-way valve 36 may be mounted in the neck 4 of the body member 2 rather than in the cap 8, while the insert 44 may be interconnected with the cap 8 by means of a reduced-thickness hinge.

Thus there is described a container of relatively simple construction capable of economic production and automated assembly that provides the consumer with numerous advantages compared with currently available products.

In particular, the container of the invention enables the consumer to dispense smooth, measured quantities either in small doses or large doses and regardless of the viscosity of the liquid.

The sizes of the outlets and the valves can readily be altered to suit different products and the dispensing requirements of the consumer, and can accommodate a wide range of products from highly viscous pastes right through to water, while rapid return of the squeezed container to its normal rest condition is ensured.

What is claimed is:

1. A container comprising a body member for containing liquid and a neck at one end thereof through which liquid flows on pressurization of the interior of the body member, and a closure for the body member including a cap located on the neck of the body member and having an outlet therein for dispensing therethrough liquid flowing through the neck of the body member a control valve located within the cap for controlling the dispensing of liquid flowing from the body member to the outlet from the cap, the control valve being a one piece plastic moulding including a diaphragm portion and a nose portion extending from one side of said diaphragm portion, and having a rest position in which the nose portion engages in, to seal, the outlet from the cap, and a one-way valve in the flow path of liquid from the body member to the outlet and communicating with the atmosphere said one-way valve having a closed position sealing the interior of the container from the atmosphere and an open position interconnecting the interior of the container with the atmosphere the arrangement being such that, on pressurization of the interior of the body member, liquid from the body member flows through the neck of the body member into the cap to close the one-way valve and to engage with the one side of the diaphragm portion of the control valve to distort said diaphragm portion whereby the nose portion of the control valve is displaced from the outlet and liquid is dispensed therethrough, and, on subsequent release of pressure from the interior of the body member, the control valve returns, under the influence of its inherent resiliency and atmospheric pressure, to its rest position with the nose portion thereof seating in, to seal, the outlet, and the one-way valve opens to facilitate re-pressurization of the interior of the body member, characterized in that the cap includes an annular seating for the control valve projecting inwardly of the cap and being of hollow, open-ended generally cylindrical shape the bore through which interconnects the interior of the cap with the atmosphere, the control valve being mounted on the seating with the diaphragm portion thereof sealing the inner end of the seating and whereby the other side of the diaphragm portion remote from the nose portion is subjected to atmospheric pressure.

2. A container as claimed in claim 1 in which the control valve is overmoulded on the inner end of the seating.

3. A container as claimed in claim 1 in which the annular seating is integrally moulded with the cap.

4. A container as claimed in claim 1 in which the annular seating is separate from, and is a push-fit into, the cap.

5. A container as claimed in claim 4 in which the separate seating has integrally formed therewith a secondary seating adapted to receive therein the one-way valve such as to locate said one-way valve in the flow path of liquid from the interior of the body member to the outlet from the cap.

6. A container as claimed in claim 4 in which the separate seating is interconnected with the cap by means of a reduced-thickness hinge.

7. A container as claimed in claim 1 in which the one-way valve is mounted in the cap.

8. A container as claimed in claim 1 in which the one-way valve is mounted in the neck, of the body member.

9. A container as claimed in claim 1 in which the outlet is formed in a plate portion movable relative to the remainder of the cap between a normal position completing the cap and a displaced position providing access to the interior of the cap and to the control valve.

10. A container as claimed in claim 9 in which the plate portion is integrally moulded with the remainder of the cap and movable relative thereto by means of a hinge.

11. A container as claimed in claim 9 in which the plate portion is separate from the remainder of the cap and is a snap fit into an associated operative position in the remainder of the cap.

12. A container as claimed in claim 1 in which the closure includes a plug member adapted to be a tight friction fit within the cap to engage the other side of the diaphragm portion of the control valve remote from the nose portion and to retain the nose portion in its rest position engaging in, to seal, the outlet.

13. A container as claimed in claim 12 in which the plug member is integrally moulded with the cap and is pivotal relative thereto about a reduced thickness hinge between an operative position engaging the diaphragm portion of the control valve and a released position displaced from the control valve.

14. A container as claimed in claim 1 in which the closure is integrally moulded with the body member to form a continuation of the neck of said body member.

15. A container as claimed in claim 1 in which the control valve is positioned within the cap with the central axis thereof at an angle to the central axis of the neck of the body member.

16. A container as claimed in claim 15 in which said angle is substantially 90°.

* * * * *